US011492869B2

(12) United States Patent
Urban et al.

(10) Patent No.: US 11,492,869 B2
(45) Date of Patent: Nov. 8, 2022

(54) BACKUP AND PACKER

(71) Applicants: Larry Urban, Santa Fe, TX (US); Gary Anderson, Houston, TX (US); Edward Kossa, Huffman, TX (US); Joshua Raymond Snitkoff, Houston, TX (US)

(72) Inventors: Larry Urban, Santa Fe, TX (US); Gary Anderson, Houston, TX (US); Edward Kossa, Huffman, TX (US); Joshua Raymond Snitkoff, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/222,411

(22) Filed: Apr. 5, 2021

(65) Prior Publication Data

US 2022/0316296 A1 Oct. 6, 2022

(51) Int. Cl.
*E21B 33/12* (2006.01)

(52) U.S. Cl.
CPC ..... *E21B 33/1216* (2013.01)

(58) Field of Classification Search
CPC ..... E21B 33/1216
See application file for complete search history.

(56) References Cited

U.S. PATENT DOCUMENTS

| | | | | |
|---|---|---|---|---|
| 6,102,117 | A | 8/2000 | Swor et al. | |
| 6,827,150 | B2 * | 12/2004 | Luke | E21B 33/1216 166/138 |
| 9,228,411 | B2 | 1/2016 | Themig | |
| 9,732,581 | B2 | 8/2017 | Morehead | |
| 9,784,066 | B1 | 10/2017 | Branton et al. | |
| 10,443,343 | B2 | 10/2019 | Doane et al. | |
| 10,612,339 | B2 * | 4/2020 | Murphy | E21B 33/1216 |
| 11,066,897 | B2 | 7/2021 | Burckhard et al. | |
| 2016/0258244 | A1 | 9/2016 | Connelly | |
| 2019/0120011 | A1 * | 4/2019 | Kellner | E21B 33/1216 |
| 2019/0368304 | A1 | 12/2019 | Deng et al. | |
| 2021/0140265 | A1 * | 5/2021 | Mitchell | E21B 33/1216 |

* cited by examiner

*Primary Examiner* — David Carroll
(74) *Attorney, Agent, or Firm* — Cantor Colburn LLP

(57) ABSTRACT

A backup including a capture ring, and a backup ring articulated to the capture ring.

15 Claims, 3 Drawing Sheets

BACKUP AND PACKER

BACKGROUND

In the resource recovery industry, Packers are oft used sealing devices that are essential for many well operations. Some are permanent and some are retrievable but in all cases they must be capable of holding significant differential pressures and pressure reversals. High element pressures are important for this utility as are back up systems to avoid element extrusion. While the art has a plethora of packers available commercially, changing industry standards, changing environmental conditions and changing economic factors require the development of new packers having similar utility while being less costly, shorter, etc.

SUMMARY

An embodiment of a backup including a capture ring, and a backup ring articulated to the capture ring.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
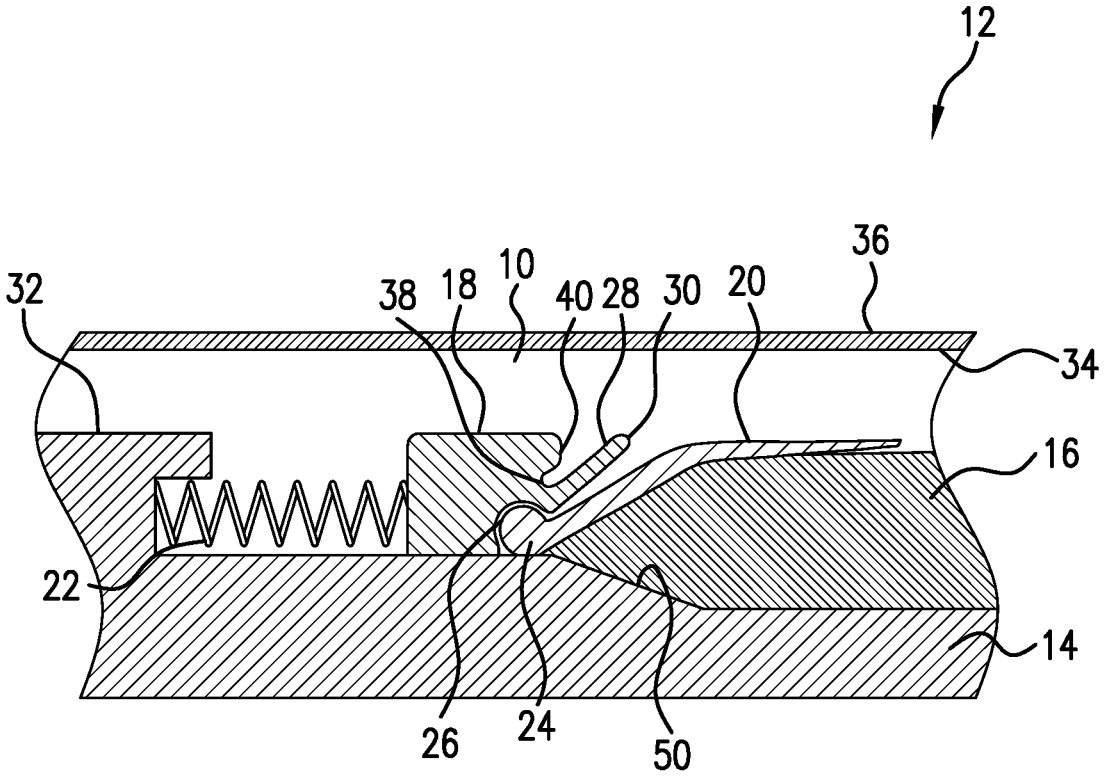
FIG. 1 is a section view of a backup as disclosed herein in a run-in position and disposed in a packer.

Referring to FIG. 1, a backup 10 is illustrated as a part of a packer 12. It is to be appreciated that the illustration is not intended to limit the application of the backup 10. Rather backup 10 is employable with any tool that requires the function of this backup. Using FIG. 1 as merely an example, the backup 10 function is used in connection with the packer 12. The backup 10 is disposed upon a mandrel 14 and adjacent a packer element 16 also disposed about the mandrel 14. The backup itself comprises a capture ring 18 and a backup ring 20. Optionally, the backup 10 may also include a resilient member 22 that functions to maintain contact between the backup ring 20 and the element 16 during running and setting.

Focusing upon the backup 10, the backup ring includes a bulbous base 24 that is articulatingly received in a recess 26 of the capture ring 18. The bulbous base 24 and the recess 26 allow a degree of freedom to the backup ring 20 to articulate relative to the capture ring 18 that would not be available in a solid base connection that relies upon material plastic deformation. The result is a much easier to set system (of a packer in this example) since less force is needed to displace the backup 10.

The capture ring 18 further includes a support member 28. The support member is cantilevered from the capture ring 18 and deforms to provide additional shear strength to the backup ring 20 during setting. The support member extends from the capture ring 18 to an extent that when deformed radially outwardly during use, a distal end 30 of the support member 28 falls between a gauge diameter 32 of the packer 12 in which the backup 10 is installed and an inside diameter surface 34 of a tubular member 36 in which the packer 12 is set. Close to the inside diameter surface 34 is desirable so long as the end 30 is not so close as to interfere with retrieval by making contact with the surface 34. The capture ring 18 also includes a stress reduction opening 38 and a load brace 40 that each work with the support member 28 to allow for deformation thereof and then support thereof by brace 40 when set. The set position of all of the components described is illustrated in FIG. 2.

It is noted that Additive Manufacture is a quite suitable method of manufacture of this complex geometry of the capture ring 18 and the backup ring 20.

Figure 2:
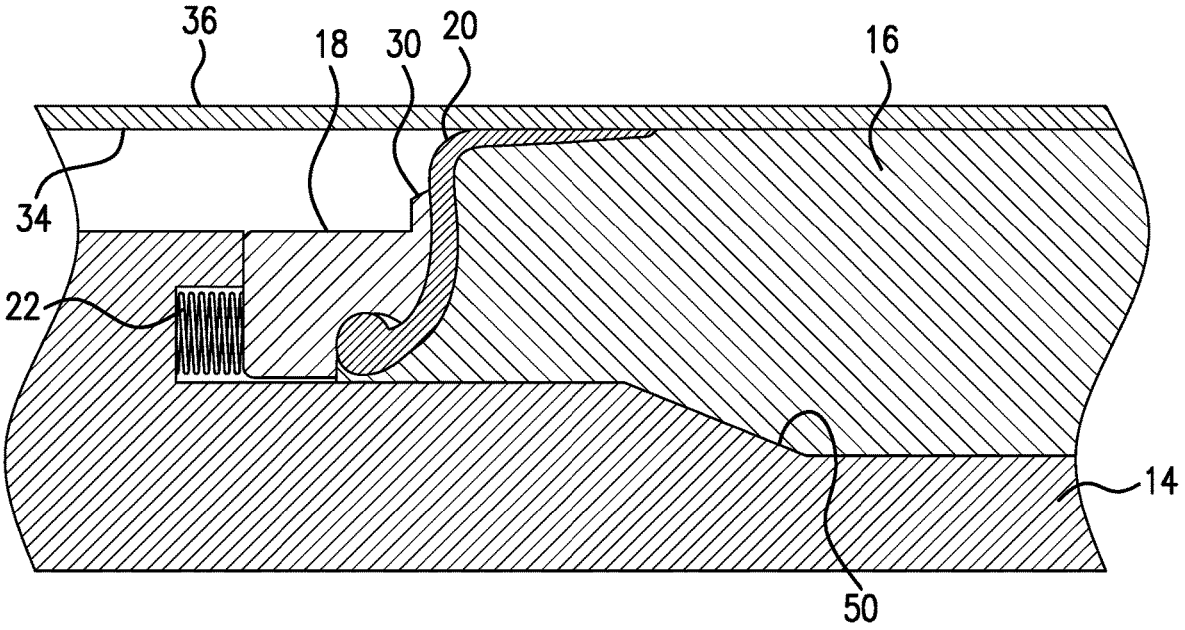
FIG. 2 is the same section view as FIG. 1 but in a set position.

Another feature of the packer 12 embodiment discussed is an intensifier configuration 50 visible in both FIGS. 1 and 2, albeit in different positions. It is to be understood that the intensifier need not be used with the backup 10 as described herein but may also be used with any seal assembly regardless of specific components of that seal assembly. The intensifier configuration 50 causes rubber pressures during deployment to be increased over what they would be based upon an equivalent setting force without the intensifier configuration 50. This means the intensifier is quite advantageous to the industry because through the use of an intensifier configuration 50, a lower setting force may be designed into a tool and yet a sufficient rubber pressure may still be achieved. This leads to less costly and shorter packers 12 (or other sealing assemblies).

Figure 3:
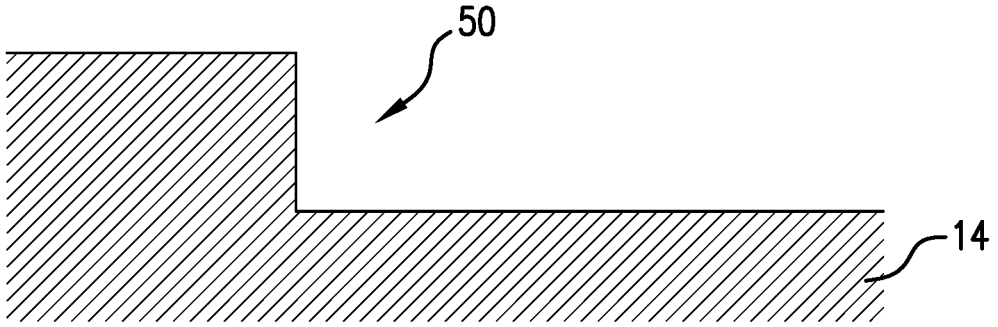
FIG. 3 is a view of an alternate intensifier configuration.

The intensifier configuration 50 is, in embodiments, a ramp extending from a smaller radial dimension section of the mandrel to a section of the mandrel having a larger radius. In other embodiments the intensifier configuration is a step between a smaller radial dimension section of the mandrel to a section of the mandrel having a larger radius. Both of these embodiments lead to a reduced annular area between the intensifier configuration 50 and the tubular structure 36 against which the packer 12 is to be set. The element 16 is forced, through relative motion between the element 16 and the mandrel 14, to reside in that reduced annular area with attendant increases in rubber pressures. In the illustrations, the intensifier configuration is a ramp, up which the element 16 is forced during setting such that the element must occupy the smaller annular dimension between the mandrel 14 and the surface 34, with the product of that action being the higher rubber pressures noted even while input force remains constant. While the ramp configuration of intensifier configuration 50 is illustrated and has the additional value of reducing element tearing due to the smooth inclined surface, it is important to note that any change in annular dimension will beget the same increase in rubber pressure when the element is forced into that smaller annular space. This is true even for a step configuration (see FIG. 3) where the outside surface of the mandrel 14 simply steps up to a larger outside diameter. Rubber pressure will be increased similar to that of the ramp embodiment though it is possible some rubber tearing may also occur due to higher shear stresses in the rubber as it attempts to flow over the step configuration 50.

Figure 4:
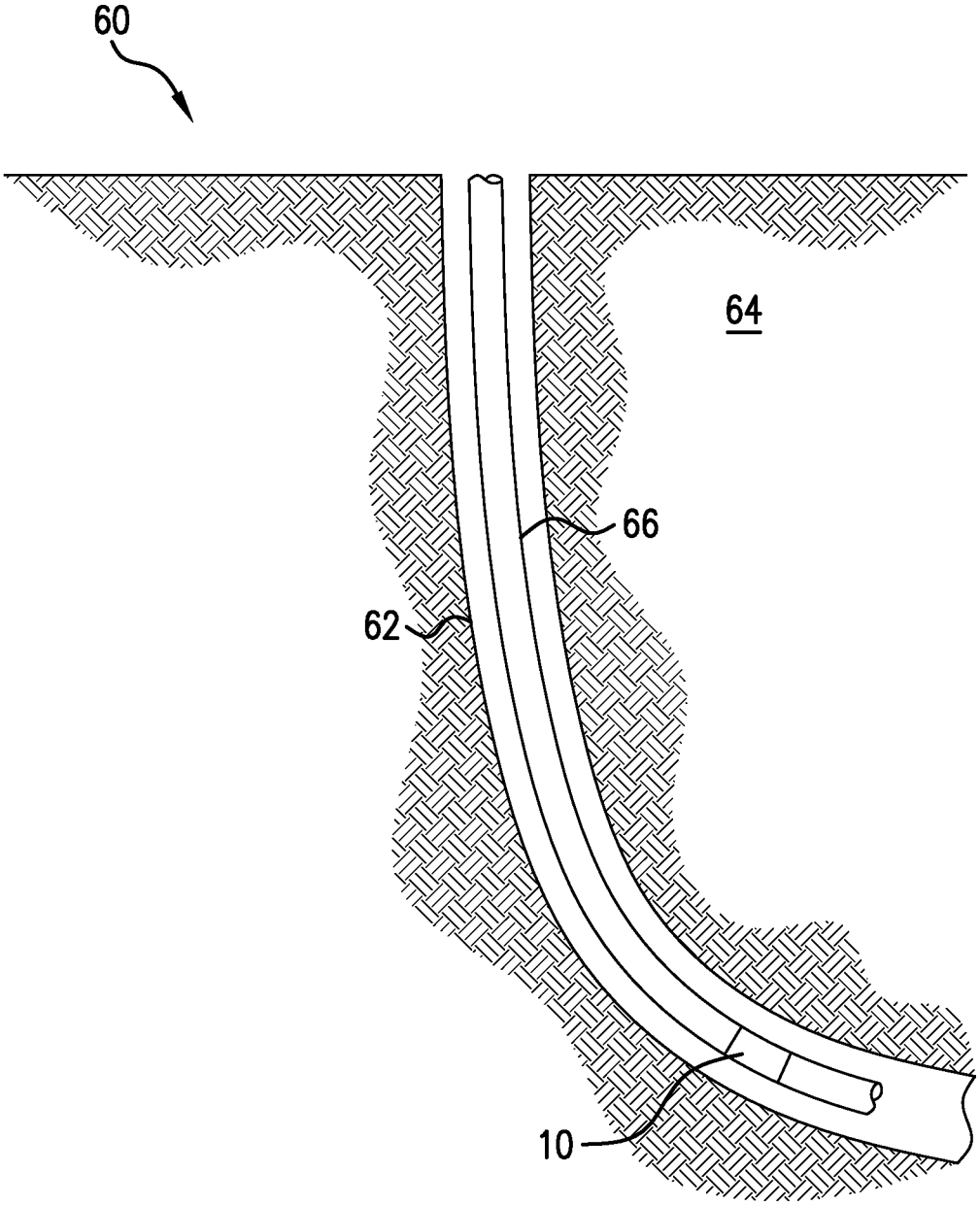
FIG. 4 is a schematic view of a wellbore system including the backup as disclosed herein.

Referring to FIG. 4, a wellbore system 60 is illustrated having a borehole 62 within a subsurface formation 64. A string 66 is disposed in the borehole 62 and a backup 10 is connected with the string 66.

Set forth below are some embodiments of the foregoing disclosure:

Embodiment 1: A backup including a capture ring, and a backup ring articulated to the capture ring.

Embodiment 2: The backup as in any prior embodiment, wherein the capture ring includes a support member.

Embodiment 3: The backup as in any prior embodiment, wherein the support member is cantilevered from the capture ring.

Embodiment 4: The backup as in any prior embodiment, wherein the support member extends from the capture ring to an extent that when deformed radially outwardly during use, a distal end of the support member falls between a gauge diameter of a packer in which the backup is installed and an inside diameter surface of a tubular member in which the packer is set.

Embodiment 5: The backup as in any prior embodiment, wherein at an intersection between the support member and the capture ring there is a stress reduction opening.

Embodiment 6: The backup as in any prior embodiment, wherein the backup ring includes a bulbous base.

Embodiment 7: The backup as in any prior embodiment, wherein the bulbous base is received in a recess of the capture ring, the bulbous base and the recess forming the articulation between the backup ring and the capture ring.

Embodiment 8: The backup as in any prior embodiment, further including a resilient member disposed adjacent the capture ring and configured to maintain the backup in contact with a packer element during use.

Embodiment 9: A packer including a mandrel, an element disposed about the mandrel, and a backup as in any prior embodiment disposed about the mandrel and adjacent the element.

Embodiment 10: The packer as in any prior embodiment, further comprising an intensifier configuration.

Embodiment 11: The packer as in any prior embodiment, wherein the intensifier configuration is a reduced annular area radially outward of the mandrel.

Embodiment 12: The backup as in any prior embodiment, wherein the intensifier configuration is a ramp.

Embodiment 13: The backup as in any prior embodiment, wherein the intensifier configuration is a step.

Embodiment 14: A wellbore including a borehole in a subsurface formation, a string in the borehole including a backup as in any prior embodiment.

Embodiment 15: The wellbore as in any prior embodiment, wherein the backup is a part of a packer.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A backup comprising:

a capture ring including a support member having a root and a distal end, the member extending from the capture ring between but not including an inside diameter of the capture ring and an outside diameter of the capture ring; and a backup ring articulated to the capture ring.

2. The backup as claimed in claim 1 wherein the capture ring includes a load brace.

3. The backup as claimed in claim 1 wherein the support member is cantilevered from the capture ring.

4. The backup as claimed in claim 1 wherein the support member extends from the capture ring to an extent that when deformed radially outwardly during use, a distal end of the support member falls between a gauge diameter of a packer in which the backup is installed and an inside diameter surface of a tubular member in which the packer is set.

5. A backup comprising:

a capture ring including a support member wherein at an intersection between the support member and the capture ring there is a stress reduction opening; and a backup ring articulated to the capture ring.

6. The backup as claimed in claim 1 wherein the backup ring includes a bulbous base.

7. The backup as claimed in claim 6 wherein the bulbous base is received in a recess of the capture ring, the bulbous base and the recess forming the articulation between the backup ring and the capture ring.

8. The backup as claimed in claim 1 further including a resilient member disposed adjacent the capture ring and configured to maintain the backup in contact with a packer element during use.

9. A packer comprising:

a mandrel;

an element disposed about the mandrel; and a backup as claimed in claim 1 disposed about the mandrel and adjacent the element.

10. The packer as claimed in claim 9 further comprising an intensifier configuration.

11. The packer as claimed in claim 10 wherein the intensifier configuration is a reduced annular area radially outward of the mandrel.

12. The backup as claimed in claim 10 wherein the intensifier configuration is a ramp.

13. A packer comprising:

a mandrel;

an element disposed about the mandrel;

a backup having a capture ring;

a backup ring articulated to the capture ring disposed about the mandrel and adjacent the element, an intensifier configuration disposed at the mandrel, wherein the intensifier configuration is a step.

14. A wellbore comprising:

a borehole in a subsurface formation;

a string in the borehole including a backup as claimed in claim 1.

15. The wellbore as claimed in claim 14 wherein the backup is a part of a packer.

* * * * *